United States Patent [19]

Svagr

[11] Patent Number: 4,457,152

[45] Date of Patent: Jul. 3, 1984

[54] APPARATUS FOR CHANGING THE TAPERED ROLLS OF A SKEW ROLLING MILL

[75] Inventor: Alexandr Svagr, Hilden, Fed. Rep. of Germany

[73] Assignee: SMS Schloemann-Siemag Aktiengesellschaft, Dusseldorf, Fed. Rep. of Germany

[21] Appl. No.: 375,569

[22] Filed: May 6, 1982

[30] Foreign Application Priority Data

May 16, 1981 [DE] Fed. Rep. of Germany ..... 3119647

[51] Int. Cl.[3] ..... B21B 31/08

[52] U.S. Cl. ..... 72/78; 72/239

[58] Field of Search ..... 72/78, 95, 100, 238, 72/239

[56] References Cited

U.S. PATENT DOCUMENTS 3,889,344 6/1975 Bode, Jr. et al. ..... 72/239

FOREIGN PATENT DOCUMENTS 2823139 11/1979 Fed. Rep. of Germany ..... 72/239

784962 12/1980 U.S.S.R. ..... 72/95

*Primary Examiner*—Lowell A. Larson

*Attorney, Agent, or Firm*—Holman & Stern

[57] ABSTRACT

The apparatus for changing the rolls (6) of a skew rolling mill comprises a roll-change carriage (14) movable along the direction of feed of material (10) being rolled. A carrier (11) is mounted on the carriage (14) and carries a plurality of roll-clamping devices (12). Locking means (19, 20) are provided for interlocking the rotor (2) carrying a plurality of roll heads (5) skew mounted thereon and the carrier (11) in a predetermined axially-aligned, spaced position for removing or replacing rolls by means of the clamping devices. In a preferred embodiment there are two carriers movable in alternate alignment with the rotor (2).

7 Claims, 6 Drawing Figures

APPARATUS FOR CHANGING THE TAPERED ROLLS OF A SKEW ROLLING MILL

This application relates to applicant's copending application Ser. No. 363,479, filed Mar. 30, 1982, titled "Skew Rolling Mill For Reducing Solid And Hollow Cross-Section", assigned to the same assignee.

BACKGROUND OF THE INVENTION

1. Field of the Invention

The present invention relates to apparatus for changing the rolls of a skew rolling mill.

2. Description of the Prior Art

In a skew rolling mill tapered rolls are arranged overhung on the end of a respective shaft on which they are detachably mounted. The shafts of the tapered rolls are inclined with respect to the axis of the material to be rolled and pass that axis at a short distance therefrom, resulting in an inclination of the tapered rolls which effects the advance of the material to be rolled. The inclination to be selected is determined by the diameter, the quality of material and the surface finish of the product to be rolled, so that in the case of a skew rolling mill provided solely for uniform application setting, means for altering the inclination may be dispensed with. Otherwise the shafts of the tapered rolls are mounted in roll heads which are pivotable about axes parallel to the axis of the material to be rolled in a roll carrier or rotor of the rolling mill in order to allow the inclination of the tapered rolls to be set. In addition, the shafts of the tapered rolls are axially adjustable in order to allow the size or the external size of the material to be rolled (solid or hollow section) to be set.

Changing the tapered rolls by means of tongs, which are suspended from a crane and grip one tapered roll in turn, is very time-consuming. For this reason changing devices are used which are provided on a carrier with a number of roll clamping devices which corresponds to the number of rolls (three). The carrier with the clamping devices is arranged on a changing carriage. The carrier is displaceable upon the said changing carriage in the direction of the axis of the material to be rolled in order to be able to bring the clamping devices to the tapered rolls. The carrier may be moved with the changing carriage transversely to the axis of the material to be rolled in order to allow the changing apparatus to be moved out of the rolling axis. In order to speed up the roll change further, the changing carriage is provided with two carriers which are pivotable about an axis arranged transverse to the axis of the material to be rolled in the manner of a revolver, so that one carrier can grip the tapered rolls to be dismounted with its clamping devices, while the other carrier holds the tapered rolls to be newly inserted with its clamping devices and conveys them (after rotation of the two carriers) to the shafts (see for example German Offenlegungsschrift No. 28 23 139).

Despite the use of the changing carriage described above, the roll change cannot be carried out in as short a time as desired, since it has been found to be difficult and time-consuming to move the clamping devices with their carriers into the position required for the roll change sufficiently precisely by means of the changing carriage and to hold them in this position.

BRIEF SUMMARY OF THE INVENTION

An object of the present invention is to provide a changing apparatus for the tapered rolls of a skew rolling mill, by means of which the roll change may be carried out as rapidly as possible and in a reliable and trouble-free manner.

The invention provides apparatus for changing the rolls of a skew rolling mill comprising a plurality of roll heads skew-mounted on a rotor rotatable about a direction of feed for material being rolled, each roll head carrying a roll axially slidable therein, the apparatus comprising a roll-change carriage movable along the said direction of feed, a carrier mounted on the carriage and carrying a plurality of roll-clamping devices, and locking means for interlocking the rotor and carrier in a predetermined axially-aligned, spaced position for removing or replacing rolls by means of the clamping devices.

The changing apparatus in accordance with the invention may be used successfully on skew rolling mills in which the shafts of the rolls are held in an unalterable inclined position. If, however, the shafts of the rolls may be set, i.e. altered, with respect to the inclined position of the rolls—as is the case with most skew rolling mills—the apparatus according to the invention could only be used if the shafts of the rolls were previously set back to a fixed, constant starting position. After the rolls have been changed the tapered rolls must then be set back again to the inclined position required in each case. These adjustments take time and, in order that the time required may be kept within acceptable limits, they also require additional structural outlay on adjustment devices. Thus it will be desirable to minimize the setting and resetting times of the rolls being changed, and to make rapid roll change possible on skew rolling mills of the type in which the roll heads are disposed in the roll carrier or rotor so as to be pivotable about axes parallel to the axis of the material to be rolled so that the distance at which the roll axes intersect the axis of the material to be rolled may be varied.

Thus in accordance with a preferred feature of the invention the roll-clamping devices of the rolls of a set to be received at the same time are pivotable relative to their carrier about axes extended from the pivot axes of the roll heads. Even during the rolling operation it is possible for the roll-clamping devices on their carriers to be set to the known roll inclination so that immediately after the end of the rolling operation the carrier with the roll-clamping devices may be inserted into the stops on the roll carrier or rotor of the rolling mill and roll changing may be commenced. In addition, the clamping devices on their carriers which carry the rolls to be newly inserted may be set to the known roll inclination, so that the new rolls may be brought to their shafts again without any loss of time.

Although the clamping jaws can grip the tapered rolls in the possible axial positions relative to one another, in order to provide a reliable, positive grip and for mounting the new rolls it is advantageous for the clamping jaws of the clamping devices to be displaceable in the direction of the roll axes in order to permit the positive connection between the clamping jaws and the rolls and to move the rolls towards the shafts axially thereto. The displaceability of the carrier of the clamping devices with or with respect to the changing carriage in the direction towards the roll carrier along the axis of the material to be rolled is preferably used at the same time to engage and conversely to disengage the locking means acting between the carrier of the clamping device and the roll carrier or rotor, after the carrier of the clamping device and the roll carrier, by rotating the carrier of the clamping device or in the case of a non-rotatable carrier after stopping the roll carrier or rotor in a given position of rotation, have been brought into an aligned position in order to allow the locking means to be engaged.

BRIEF DESCRIPTION OF THE DRAWINGS

The invention will now be described in greater detail with reference to the accompanying drawings, wherein.

DETAILED DESCRIPTION

Figure 1:
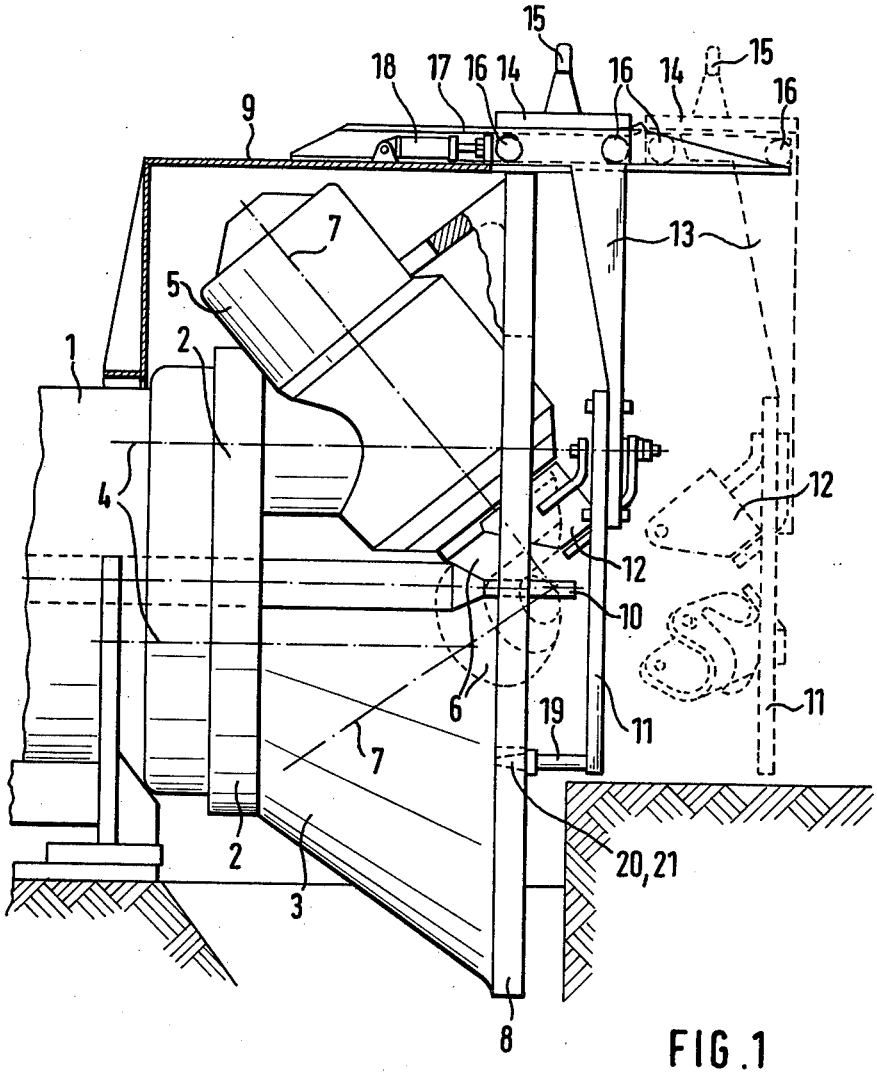
FIG. 1 is a side elevational view of a first embodiment of apparatus for changing the rolls of a skew rolling mill in accordance with the invention.
Figure 2:
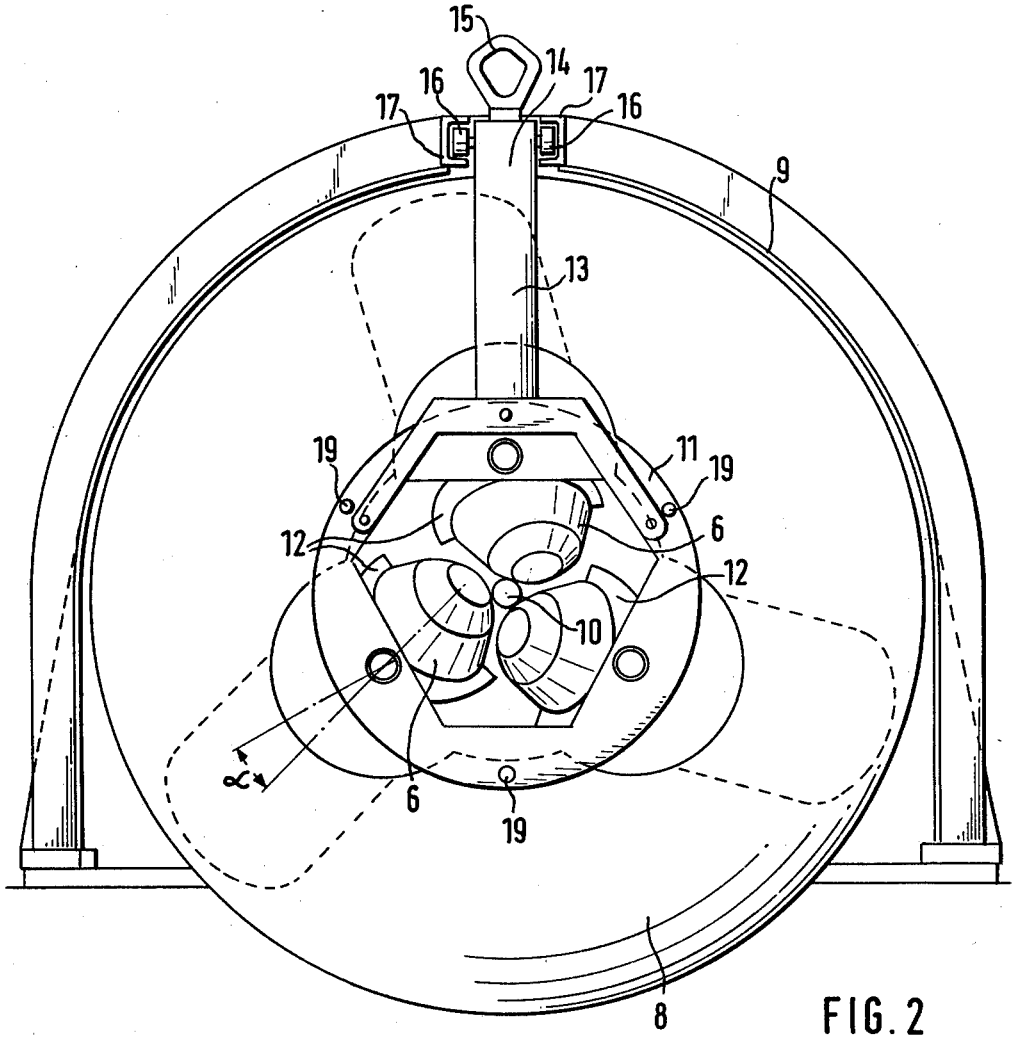
FIG. 2 is a front elevational view of the embodiment of FIG. 1.

In the embodiment shown in FIGS. 1 and 2, details not essential to the invention have been omitted. FIGS. 1 and 2 show part of a planetary skew rolling mill comprising a stator 1 on which a roll carrier or rotor 2 is mounted and is driven by a drive (not shown), and which is known, for example from the German Auslegeschrift No. 16 02 153. The rotor 2 has a lantern-like or frusto-conical front attachment 3. Roll heads 5 pivotable about axes 4 are arranged in the rotor 2. Shafts 7 carrying tapered rolls 6 are mounted in the roll heads 5. The inclination of the rolls 6, indicated by the angle $\alpha$, may be altered by pivoting the roll heads 5 about the axis 4. The Frusto-conical-shaped front attachment 3 terminates in a front flange 8. The roll carrier or rotor 2 has a cover 9. The diameter of the material 10 to be rolled leaving the rolling mill may be set by axially adjusting the rolls 6 by the shafts 7 or sliding bushes mounted on the shafts 7.

In the embodiment shown in FIGS. 1 and 2, roll-changing apparatus comprises a carrier 11 provided with a respective clamping device 12 for each roll 6. Details and operation of the clamping devices 12 will be described later with reference to FIGS. 3 and 4. In the example shown in FIGS. 1 and 2, the carrier 11 of the clamping devices 12 is supported by a downwardly-directed arm 13 of a changing carriage 14. The changing carriage 14 is designed to be suspended from a crane and for this purpose is provided with a ring 15. The changing carriage 14 is conveyed by a crane (not shown) and has wheels 16 engaging a guide track 17 comprising two channel-shaped rails i.e. having a "U" cross-section which are L-shaped in the area in which the changing carriage 14 is fitted. In this fitting area, the guide track is open towards the top.

The changing carriage 14, lowered by the crane, may be connected to a piston rod of a displacement cylinder 18 and may be moved in the guide track 17. Spacer pins 19 having centering points 20 engage in bores 21 in the annular front flange 8 of the roll carrier or rotor 2, which is moved into a fixed rotary position upon stopping. In this way the carrier 11 of the clamping device 12 is locked relative to the roll carrier 2. The clamping devices 12 now grip the rolls 6 to be changed and, after the rolls 6 have been detached from their shafts 7, the rolls 6 may be moved away as the changing carriage 14 is moved back into the fitting area of the guide track 17 by means of the displacement cylinder 18. The crane then exchanges the changing carriage 14 for another which carries the rolls 6 to be newly fitted, and by moving this changing carriage 14 the new rolls 6 are brought into the position in which they may be joined to their shafts 7.

Instead of exchanging the roll-changing carriage 14, a changing carriage could alternatively be used having a horizontal arm rotatable about a vertical axis, opposite ends of the arm each being provided with a carrier and a set of clamping devices. Although it is advantageous from the structural point of view for the guide track 14 to be supported by the covering hood 9 as shown in FIGS. 1 and 2, a changing carriage may be provided which moves on rails and two carriers 11 with roll-clamping devices 12 may be arranged on the changing carriage so as to be pivotable about a vertical axis, the design of the changing carriage otherwise being the same (see for example German Offenlegungsschrift No. 28 23 139).

Figure 3:
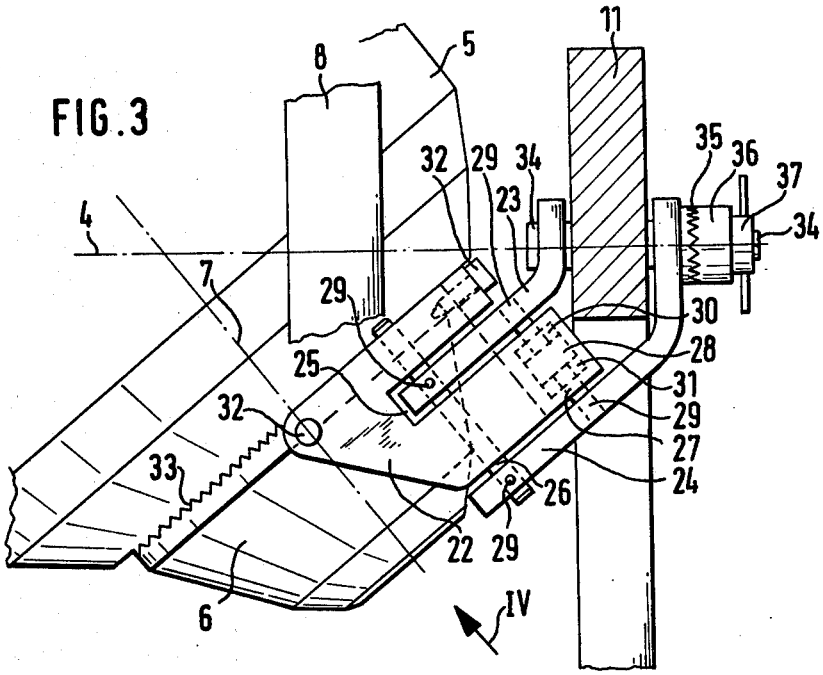
FIG. 3 is an elevational view of a detail of FIG. 1 on a larger scale.
Figure 4:
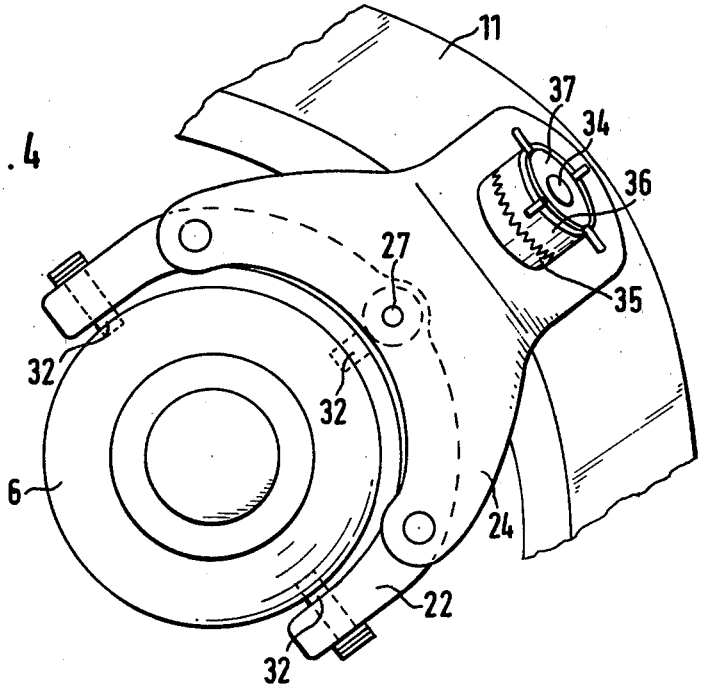
FIG. 4 is a view seen in the direction of arrow IV in FIG. 3.

An important part of the invention is also the design of the clamping devices 12 and their connection to the respective carriers 11, which is explained in greater detail with reference to FIGS. 3 and 4. The clamping devices 12 each consist of grippers 22 supported by arms 23 and 24, the arms 23 engaging in a slot 25 in the gripper 22 and the arm 24 engaging under the gripper 22. Guide rods 26 and a piston rod 27 with a piston 28 are inserted in bores in the arms 23 and 24 and are secured by pins 29. The grippers 22 are slidable on the guide rods 26 and on the piston rod 27. The gripper 22 is displaced by hydraulic actuation of the piston 28 in one of the two cylinder working spaces 30, 31 of the cylinder space formed in the gripper 22. The gripper 22 is provided at three points with gripping fingers 32 which are movable axially in a manner not shown, and may be engaged in notches provided on the rolls 6. By sliding the gripper 22 along the guide rods 26 and the piston rod 27, the gripper 22 may be moved into a position corresponding to the axial position of the roll 6. After engagement of the gripping fingers 32 and the detachment of the roll 6 from its shaft 7, the roll 6 may be disengaged from the radial serration 33 connecting the roll 6 rotationally rigidly to the shaft 7, so that the roll change may then be carried out. The new rolls are fitted in the reverse sequence. The play between the gripper 22 and the arms 23 and 24 (which defines the maximum displacement path of the gripper 22) is determined according to structural conditions (e.g. available axial screw-down movement of the rolls 6, tooth depth of the radial serration 33). The grippers 22 provided with gripping fingers 32 may also be replaced by grippers constructed in the manner of tongs and each formed by a pair of forked levers which grip the rolls at one pair of ends while a power appliance operates between the other ends.

As already explained, the roll head housings 5 are pivotable about their axes 4 in order to set the inclination of the rolls 6 with respect to the axis of the material to be rolled. Thus, the clamping devices 12 are also pivotable relative to the carrier 11 about pivot axes extending from the pivot axes 4 of the roll head housings 5. For this purpose the arms 23 and 24 carrying each gripper 22 are pivotable about a pin 34, which is inserted rotationally rigidly in the carrier 11. The arm 24 is connected rotationally rigidly to a radially serrated washer 35, engaged by a locking washer 36 mounted rotationally rigid but axially-displaceable on the pin 34. When the washer 35 and the locking washer 36 are disengaged, the clamping device 12 with the gripper 22 may be set in an inclined position corresponding to the respective position of the roll and may be secured in this position. This takes place before the roll change, so that roll change may be begun immediately after the end of a rolling operation, without it being necessary to move the rolls first into a basic position.

In order to be able to set the corresponding inclination in advance, measuring scales or similar measuring devices (not shown) are provided between the roll head housings 5 and the roll carrier or rotor 2, and between the arms 24 and the carrier 11. A nut 37 mounted on the pin 34 secures the engagement between the washer 35 and the locking washer 36.

Figure 6:
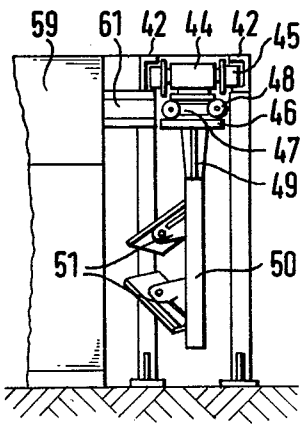
FIG. 6 is a side elevational view of the embodiment of FIG. 5.
Figure 5:
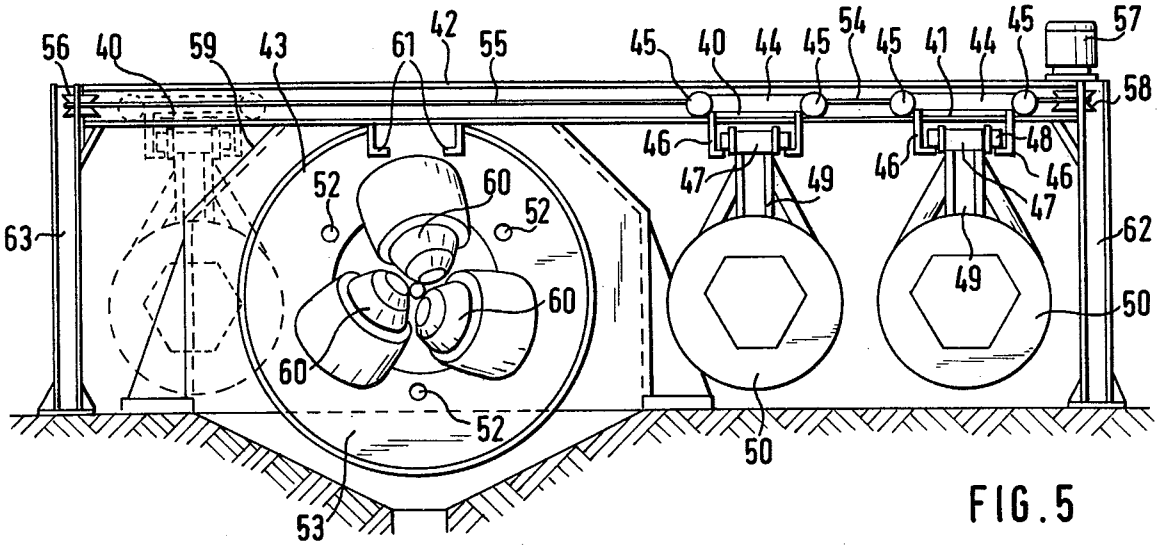
FIG. 5 is a front elevational view of a second embodiment of apparatus of the invention for changing the rolls of a skew rolling mill.

In the embodiment shown in FIGS. 5 and 6, two changing carriages 40 and 41 are suspended in a guide track 42 and are movable therealong transversely to the axis of the rolling mill 43. Each changing carriage 40, 41 comprises a bogie 44 having wheels 45 engaging in the guide track 42. Guide rails 46, which receive a second bogie 47 having wheels 48, are arranged below the bogie 44 at right angles to the guide track 42. The second bogie 47 is provided with a downwardly-directed arm 49 to which a carrier 50 for clamping devices 51 is secured. The carrier 50 may be aligned by setting means (not shown) in the connection between the arm 49 and the bogie 47 or the carrier 50, so that locking means connected thereto may be brought into a position corresponding to locking means (centering bores 52) on the roll carrier or rotor 53.

The changing carriages 40 and 41 are connected together by traction means 54 and are further connected to a rope drive 55 which is guided over a guide roller 56 and a capstan drum 58 driven by a geared motor 57. The changing carriages 40 and 41 may be moved along the guide track 42 by means of the rope drive 55.

During the rolling operation the changing carriages 40 and 41 are in the position illustrated in FIG. 5. The rolls required for the next application are clamped into the clamping devices 51 on the changing carriage 41. The inclination of the clamping devices 51 is adapted to that of the rolls 60 in the rolling mill 43. At the end of the rolling operation the changing carriages 40 and 41 are moved jointly in the guide track 42 transversely to the rolling mill 43 until the changing carriage 40 is coaxially-aligned with the rolling mill 43. The bogie 47 in the changing carriage 40 is then moved in the direction of the rolling mill 43, so that the clamping devices 51 in the changing carriage 40 grip the rolls 60 of the rolling mill 43. Reference is made in particular to the functions which are described in connection with FIGS. 3 and 4. When the rolls 60 to be detached are received by the clamping devices 51 of the changing carriage 40, the bogie 47 is moved back into the changing carriage 40 and then both changing carriages are moved jointly in such a way that the changing carriage 41 comes into axial alignment with the rolling mill 43, and the changing carriage 40 reaches the position shown in broken lines in FIG. 5 on the left-hand-side of the rolling mill 43. For movement of the carrier 50 with the clamping devices 51 towards or away from the rolling mill 43 in the direction of the main axis thereof, a guide 61 is provided on the covering hood 59 of the rolling mill 43 as an extension of the aligned guide rails 46, the said guide 61 acting at the same time as a support for the guide track 42 which thus requires no additional supports apart from end supports 62 and 63. Thus, the floor area around the rolling mill 43 is completely clear.

I claim:

1. Apparatus for changing the rolls of a skew rolling mill having a plurality of roll-heads skew-mounted on a rotor rotatable about a direction of feed axis of the material being rolled and a tapered roll rotatably and axially slidably mounted in each roll-head, comprising: a roll-change carriage, means to support said carriage for movement substantially parallel to the direction of feed axis, a carrier mounted on said carriage, a plurality of roll-clamping devices mounted on said carrier, means for interlocking said carrier to the rotor in a predetermined axially-aligned, spaced position to prevent relative rotation of said carrier with respect to said rotor during operation of said clamping devices to remove and replace the rolls comprising circumferentially spaced centering pins mounted on said carrier on the side facing said rotor and cooperating circumferentially spaced centering bores in said rotor adapted to receive said pins when said carrier is moved into position for clamping, and means to move said clamping devices relative to said carrier axially with respect to the rotatable axis of the rolls.

2. Apparatus as claimed in claim 1 wherein the roll-heads are pivotally mounted on an axis parallel to the direction of feed, further comprising means to pivotally mount said clamping device for pivotal movement with respect to said carrier about an axis parallel to the direction of feed.

3. Apparatus as claimed in claim 1 wherein said carrier is mounted on said carriage for movement therewith in a direction parallel to the direction of feed to interlock said pins in said bores.

4. The apparatus as claimed in claim 1 and further comprising a carrier support arm pivotally mounted on said carriage for rotation about a vertical axis, said carrier is mounted on said arm on one side of said pivotal axis of the arm, and a second said carrier with second said roll-clamping devices and second interlocking means thereon is mounted on said arm on the other side of said pivotal axis facing oppositely to the first mentioned carrier, so that said carriers may be pivoted alternately into axial alignment with said rotor.

5. Apparatus as claimed in claim 1 and further comprising a second carriage, having second said carrier, interlocking means and roll-clamping devices thereon, and means to support said carriage for movement transverse to the direction of feed for alternate alignment with said rotor.

6. Apparatus as claimed in claim 1 and further comprising a housing member partially enclosing said rotor and roll-heads, and wherein said means to support said carriage comprises a guide track mounted on said housing and extending in a direction parallel to the feed direction, wheels on said carriage operatively engaging in said guide track, drive means connected between said housing and said carriage to move said carriage along said guide track, and means on said carriage for suspending said carriage from a crane.

7. Apparatus as claimed in claim 2 wherein said carrier is substantially in the form of an annular plate member, and said means for pivotally mounting each clamping device comprises a pin member mounted in said carrier with its longitudinal axis parallel to the feed direction, two clamp supporting brackets pivotally mounted on said pin one on each side of said carrier and adjustable means to retain said brackets in a fixed position on said pin, each clamping device being supported on said clamp supporting brackets.

* * * * *